US012137782B2

(12) United States Patent
Sing et al.

(10) Patent No.: US 12,137,782 B2
(45) Date of Patent: Nov. 12, 2024

(54) LAPTOP LIFT CASE

(71) Applicant: TARGUS INTERNATIONAL LLC, Anaheim, CA (US)

(72) Inventors: Ma Yiu Sing, Yuen Long (HK); Xin Fu, Anaheim, CA (US)

(73) Assignee: Targus International LLC, Anaheim, CA (US)

( * ) Notice: Subject to any disclaimer, the term of this patent is extended or adjusted under 35 U.S.C. 154(b) by 0 days.

(21) Appl. No.: 17/648,119

(22) Filed: Jan. 14, 2022

(65) Prior Publication Data

US 2023/0225474 A1 Jul. 20, 2023

(51) Int. Cl.

| | |
|---|---|
| ***A45C 13/02*** | (2006.01) |
| ***A45C 11/00*** | (2006.01) |
| ***A45C 13/00*** | (2006.01) |
| ***A45C 13/10*** | (2006.01) |
| ***A45F 3/04*** | (2006.01) |
| *A45F 3/00* | (2006.01) |

(52) U.S. Cl.

CPC ..... *A45C 13/001* (2013.01); *A45C 11/00* (2013.01); *A45C 13/02* (2013.01); *A45C 13/103* (2013.01); *A45C 13/1076* (2013.01); *A45F 3/04* (2013.01); *A45C 2011/003* (2013.01); *A45C 2013/025* (2013.01); *A45C 2013/1015* (2013.01); *A45F 2003/001* (2013.01); *A45F 2003/003* (2013.01)

(58) Field of Classification Search

CPC ..... Y10S 206/804; B65D 5/724
USPC ..... 206/804, 39.4; 224/196
See application file for complete search history.

(56) References Cited

U.S. PATENT DOCUMENTS 963,229 A * 7/1910 Leighton ..... B65D 5/643 206/254
4,210,230 A 7/1980 Weiner
(Continued)

FOREIGN PATENT DOCUMENTS

CN 203505783 U 4/2014
KR 20140022393 A 2/2014
(Continued)

OTHER PUBLICATIONS

International Search Report and Written Opinion for International PCT Application No. PCT/US2023/060255, mailed May 12, 2023, 11 pages.
(Continued)

*Primary Examiner* — Scott T McNurlen
(74) *Attorney, Agent, or Firm* — Stoel Rives LLP

(57) ABSTRACT

The present disclosure provides various embodiments of cases for lifting portable electronic devices (PEDs) from a compartment of the case. Such a case may comprise a compartment with a rear wall and a front wall coupled to the rear wall with a space disposed between the walls. A lift member may be at least partially disposed within the compartment with an end of the lift member coupled to the front wall. The lift member may comprise a handle and a cradle portion. The cradle portion may support the PED within the compartment and upwardly lift the PED relative to the compartment when the handle is upwardly displaced by a user. Accordingly, a larger portion of the PED is exposed outside of the compartment allowing for easy removal of the PED from the compartment.

18 Claims, 11 Drawing Sheets

(56) References Cited

U.S. PATENT DOCUMENTS

| | | | | |
|---|---|---|---|---|
| 4,541,556 | A * | 9/1985 | Collins | B26B 29/025 206/250 |
| 5,160,001 | A * | 11/1992 | Marceau | G06F 1/1628 190/902 |
| 6,210,037 | B1 | 4/2001 | Brandon | |
| RE37,915 | E | 12/2002 | Lapoint | |
| 6,827,185 | B2 | 12/2004 | Scicluna | |
| 6,948,600 | B2 * | 9/2005 | Chuang | A45C 3/02 206/583 |
| 7,467,695 | B2 | 12/2008 | Gormick et al. | |
| 7,503,440 | B2 | 3/2009 | Gormick et al. | |
| 7,845,508 | B2 | 12/2010 | Rothschild et al. | |
| 8,164,222 | B2 | 4/2012 | Baarman | |
| 8,448,828 | B2 | 5/2013 | Nitti | |
| 8,567,578 | B2 | 10/2013 | Cuong et al. | |
| 8,714,389 | B2 | 5/2014 | Rothschild et al. | |
| 8,789,731 | B2 | 7/2014 | Hart | |
| 9,320,341 | B2 * | 4/2016 | Majeau | A45F 3/04 |
| 9,326,574 | B2 | 5/2016 | Dissegna | |
| 9,480,317 | B2 | 11/2016 | Rothschild et al. | |
| 9,750,321 | B2 | 9/2017 | Kandel | |
| 9,814,298 | B2 * | 11/2017 | Paduano | A45F 3/04 |
| 10,092,074 | B2 | 10/2018 | Rothschild et al. | |
| 10,575,612 | B2 | 3/2020 | Meservey | |
| 10,952,522 | B2 * | 3/2021 | D'Alessandro | A45F 3/047 |
| 11,359,755 | B2 * | 6/2022 | Molineux | F16L 57/06 |
| 11,399,605 | B2 | 8/2022 | Ratigan | |
| 2005/0241972 | A1 * | 11/2005 | Hassett | A45C 13/1053 206/320 |
| 2006/0144663 | A1 * | 7/2006 | Gullen | A45C 13/02 190/110 |
| 2007/0025647 | A1 | 2/2007 | Hamlin | |
| 2008/0035506 | A1 * | 2/2008 | Rostami | A45C 11/00 206/320 |
| 2009/0071782 | A1 * | 3/2009 | Rasmussen | G06F 1/1628 190/109 |
| 2010/0022285 | A1 | 1/2010 | Randall et al. | |
| 2010/0312938 | A1 | 12/2010 | Stampfli | |
| 2011/0198374 | A1 | 8/2011 | Majeau | |
| 2016/0285301 | A1 | 9/2016 | Kim | |
| 2016/0324300 | A1 | 11/2016 | Wronski | |
| 2016/0372973 | A1 | 12/2016 | Fitzgerald et al. | |
| 2018/0062417 | A1 | 3/2018 | Choi et al. | |
| 2019/0191836 | A1 | 6/2019 | Fields | |
| 2019/0256276 | A1 | 8/2019 | Barlas et al. | |
| 2020/0253349 | A1 | 8/2020 | Quartarone, III | |
| 2020/0352294 | A1 | 11/2020 | Davis | |
| 2021/0186186 | A1 | 6/2021 | D'Alessandro | |
| 2021/0330101 | A1 * | 10/2021 | Tencza | A47G 9/10 |
| 2022/0041323 | A1 | 2/2022 | Semmelhack et al. | |

FOREIGN PATENT DOCUMENTS

| | | | |
|---|---|---|---|
| WO | 2006105791 | A2 | 10/2006 |
| WO | 2022140727 | A1 | 6/2022 |

OTHER PUBLICATIONS

"Targus 15-16" Zero Waste Backpack (TBB641GL) (Amazon) Feb. 7, 2023 (Feb. 7, 2023) [online] (retrieved from the internet on Nov. 6, 2023) <URL https://www.amazon.com/Targus-15- 16-Waste-Backpack-TBB641GUdp/BOBV479JJM?th=1 >, entire document.

"DIV: Bag Base Shaper" (Mantharay27) Jul. 17, 2012 (Jul. 17, 2012), [online] (retrieved from the internet on Nov. 6, 2023) <URL https://www.youtube.com/watch?v=2GHOkeJQHEw>, entire document, especially Time 0:01 min; Time 0:10-0:14 min; Time 0:30-3:30 min.

* cited by examiner

LAPTOP LIFT CASE

TECHNICAL FIELD

The present disclosure relates generally to carrying bags. More specifically, the present disclosure relates to carrying bags for portable electronic devices. More specifically, the present disclosure relates to a lift for a portable electronic device carrying bag.

BRIEF DESCRIPTION OF THE DRAWINGS

The embodiments disclosed herein will become more fully apparent from the following description and appended claims, taken in conjunction with the accompanying drawings. These drawings depict only typical embodiments, which will be described with additional specificity and detail through use of the accompanying drawings in which:

DETAILED DESCRIPTION

The present disclosure provides various embodiments of cases for lifting portable electronic devices (PEDs) from a compartment of the case. Such a case may comprise a compartment with a rear wall and a front wall coupled to the rear wall with a space disposed between the walls. A lift member may be at least partially disposed within the compartment with an end of the lift member coupled to the front wall. The lift member may comprise a handle and a cradle portion. The cradle portion may support the PED within the compartment and upwardly lift the PED relative to the compartment when the handle is upwardly displaced by a user. Accordingly, a larger portion of the PED is exposed outside of the compartment allowing for easy removal of the PED from the compartment.

A "portable electronic device" (PED) as used throughout the disclosure may include any of a wide variety of electronic devices. Specifically contemplated and illustrated are tablet-style electronic devices, including, but not limited to, electronic readers, tablet computers, tablet PCs, mini tablets, phablets, cellular phones (including smart phones), interactive displays, video displays, touch screens, touch computers, etc.).

Figure 1:
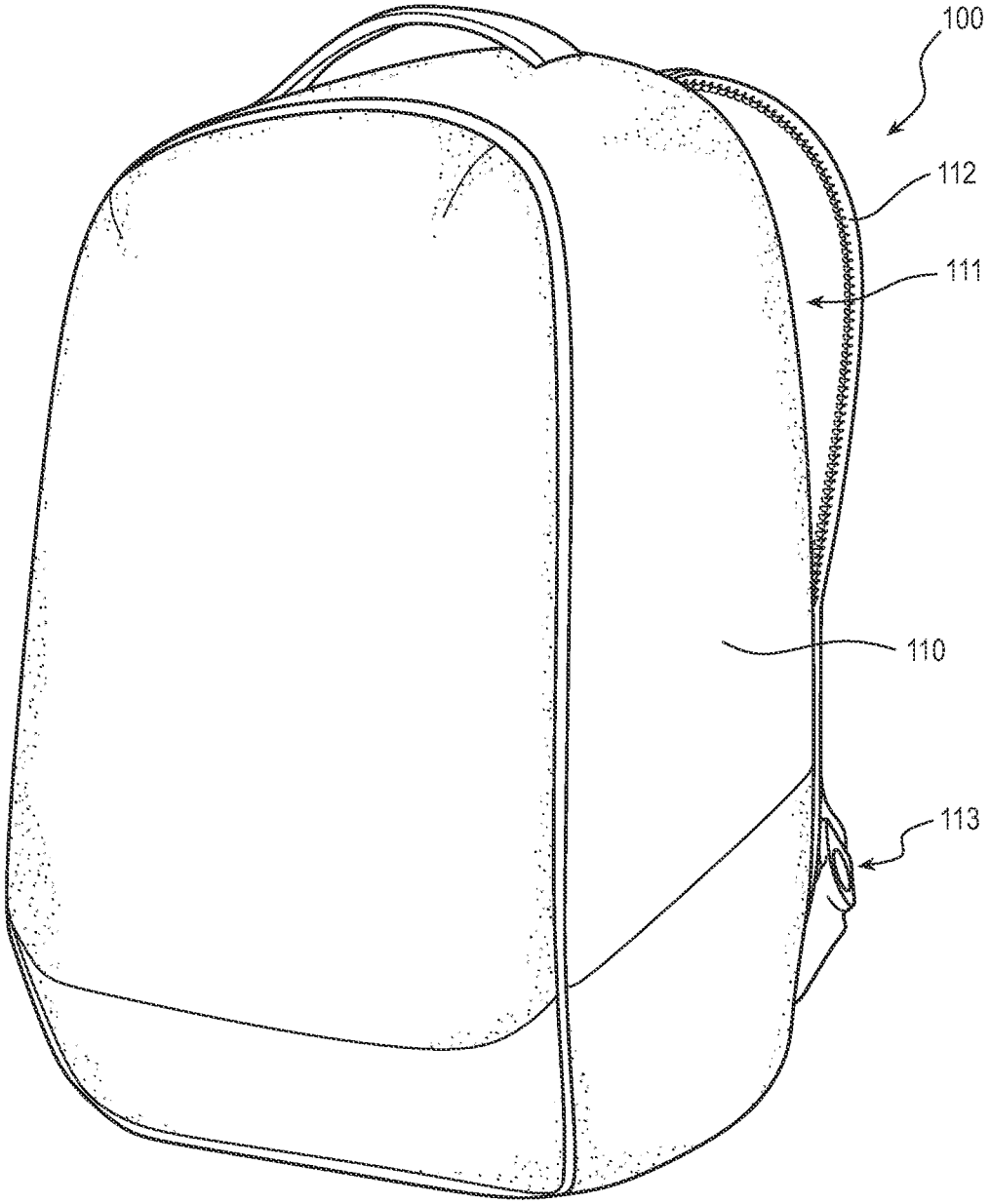
FIG. 1 is a perspective view of an embodiment of a portable electronic device carrying bag.
Figure 10:
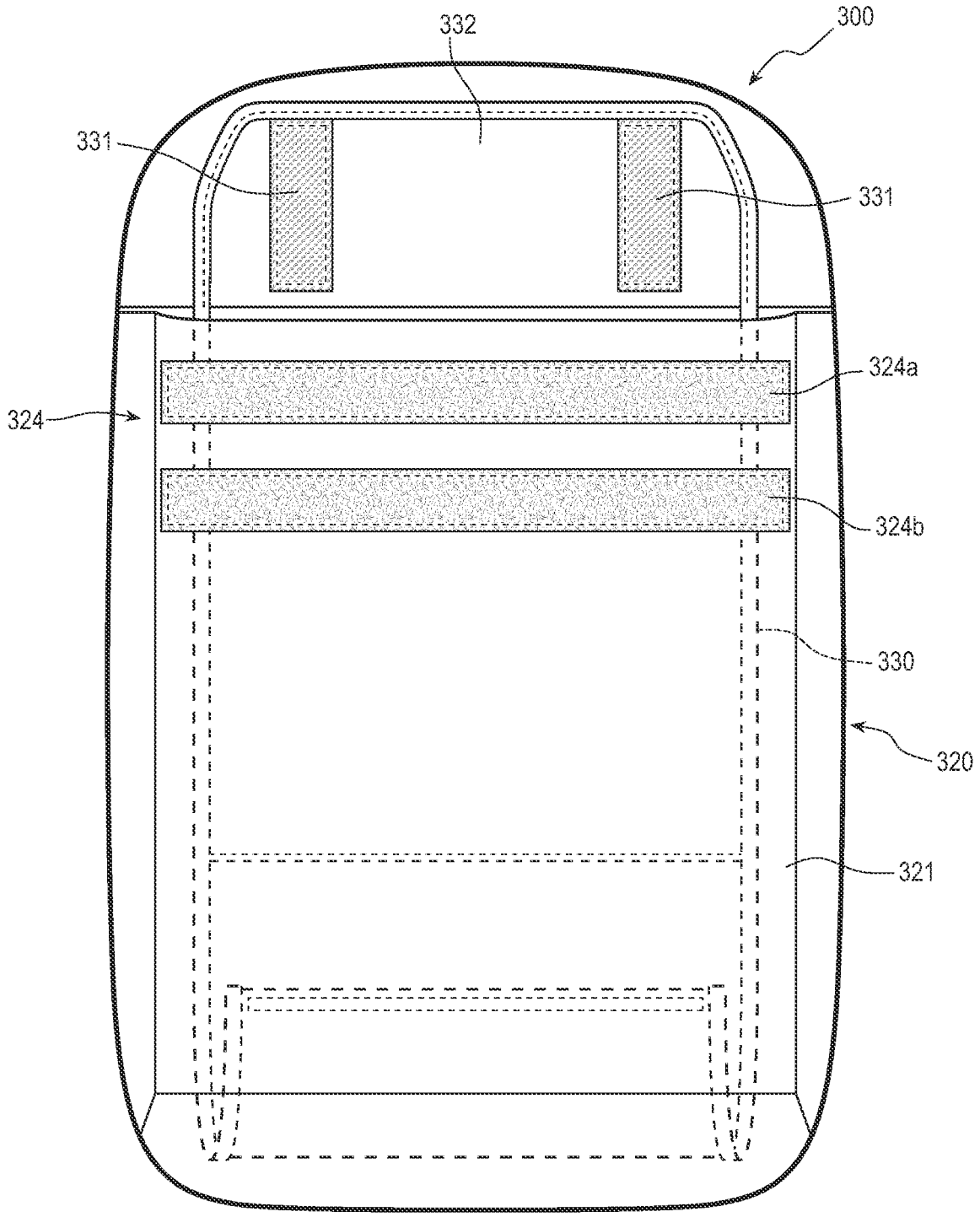
FIG. 10 is a front view of another portable electronic device pocket of the portable electronic device carrying bag of FIG. 1.
Figure 11D:
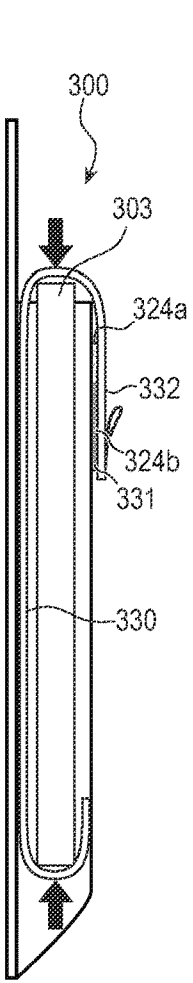
FIG. 11D is a cross-sectional view of the portable electronic device pocket of FIG. 10 with the handle of the lift member in the second securement position.

FIG. 1 illustrates an embodiment of a case for carrying a PED. FIGS. 2A-5B illustrate an embodiment of a PED compartment having an embodiment of a lift member. FIGS. 6A-9B illustrate another embodiment of the PED compartment having another embodiment of the lift member. FIGS. 10-11D illustrate another embodiment of the PED compartment having another embodiment of the lift member. In certain views, each device may be coupled to, or shown with, additional components not included in every view. Further, in some views only selected components are illustrated, to provide detail into the relationship of the components. Some components may be shown in multiple views, but not discussed in connection with every view. Disclosure provided in connection with any figure is relevant and applicable to disclosure provided in connection with any other figure or embodiment.

FIG. 1 illustrates a PED carrying case 100. As illustrated, the PED carrying case 100 comprises an outer shell 110 that defines one or more internal compartments 111. For example, the outer shell 110 may define a PED compartment. The PED carrying case 100 can also include a closing member 112 (e.g., zipper) configured to allow a user to selectively open and close the PED carrying case 100 to provide access to items within the internal compartments 111 and to protect the items within the internal compartments 111. The PED carrying case 100 may also include a carrying member 113 configured to allow a user to carry the PED carrying case 100 in a hand or on a shoulder. For example, in one embodiment, the carrying member 113 may be a handle to be grasped by a hand of the user. In another embodiment, the carrying member 113 can be straps configured to be disposed over a shoulder of the user to carry the PED carrying case 100 on a back of the user.

Figure 2A:
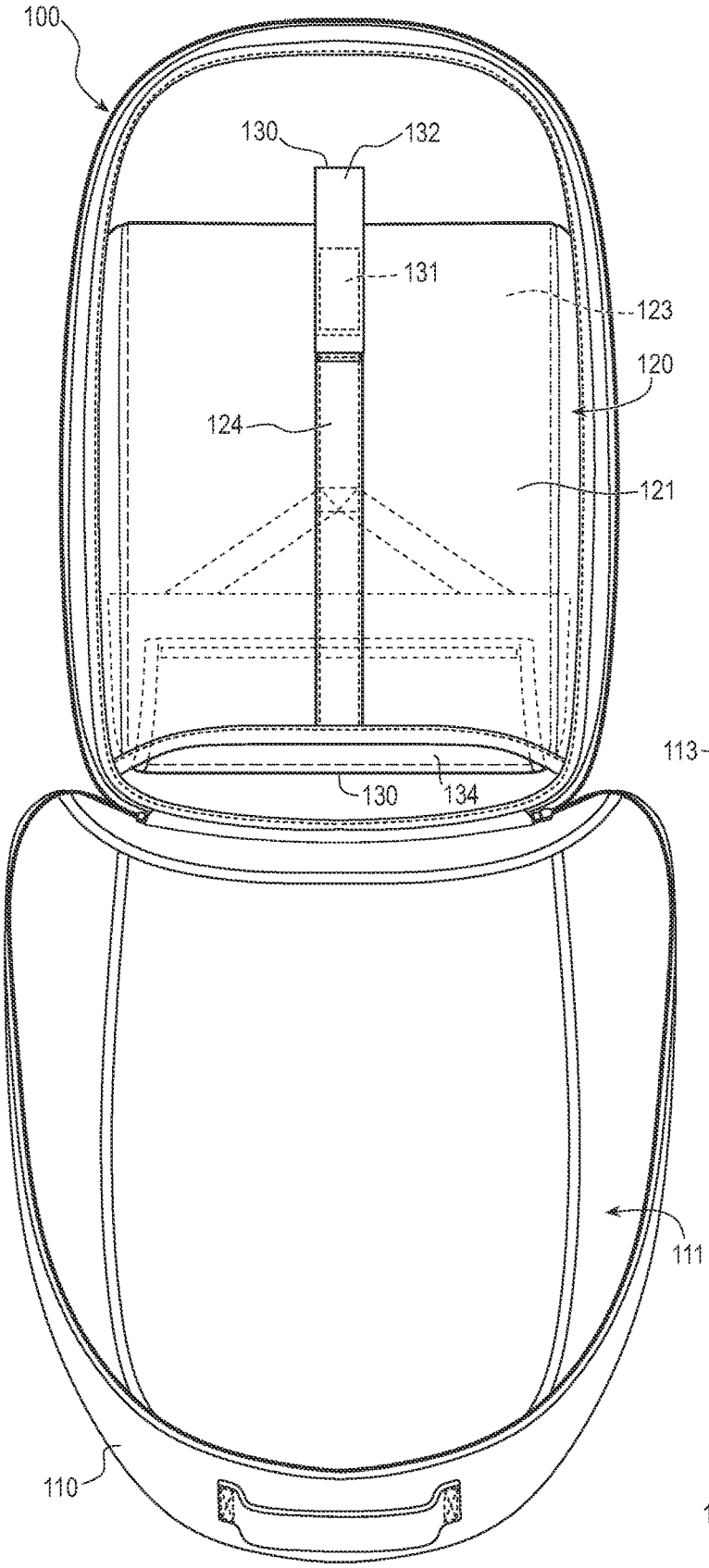
FIG. 2A is a front view of a portable electronic device pocket of the portable electronic device carrying bag of FIG. 1 having a lift member.
Figure 2B:
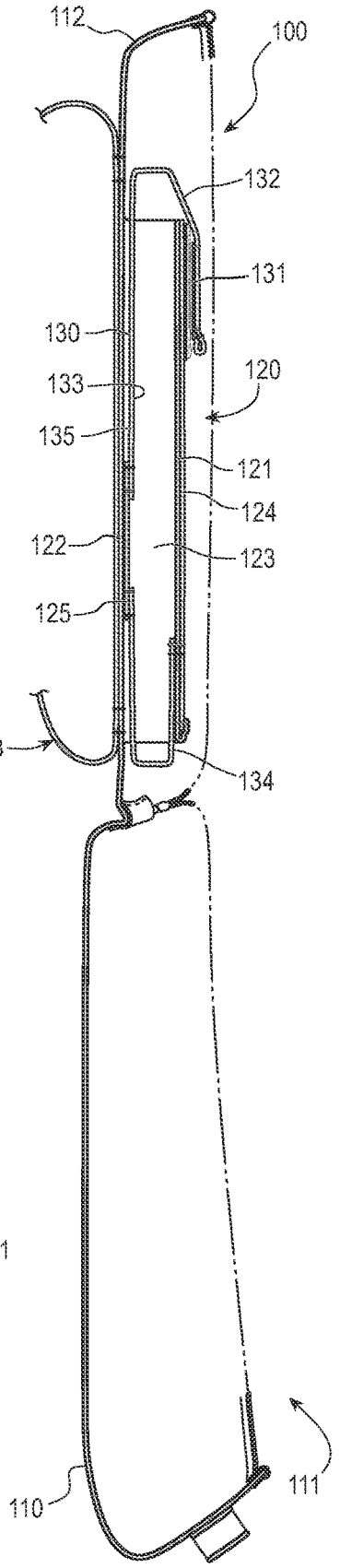
FIG. 2B is a cross-sectional view of the portable electronic device pocket and lift member of FIG. 2A.

FIGS. 2A and 2B illustrates a PED compartment or pocket 120 of the PED carrying case 100. As illustrated, the PED compartment 120 includes a front wall 121 and a back wall 122. A space 123 configured to accommodate a PED is disposed between the front wall 121 and the back wall 122. The PED compartment 120 is open at a top end and may be open at a bottom end. In other embodiments, the PED compartment 120 is closed at the bottom end. The front wall 121 and/or the back wall 122 may be padded to provide protection from an impact force to the PED. The PED compartment 120 can be sized to accommodate a variety of PED sizes.

A securement member 124 can be coupled to the front wall 121. The securement member 124 may be configured to releasably couple to a mating securement member 131 of a PED lift member 130. The securement members 124, 131 may be any suitable securement mechanism that allows a user to selectively secure and unsecure the PED within the PED compartment 120. For example, the securement members 124, 131 may be one or more of a hook-and-loop material, a snap, a magnetic snap, etc.

As depicted in FIGS. 2A and 2B, the PED compartment 120 can include a PED lift member 130 at least partially disposed within the PED compartment 120. The PED lift member 130 can include a lift handle 132 and a cradle lift 133 coupled to the lift handle 132. An end of the cradle lift 133 can be connected to an inner surface of the front wall 121 using any suitable technique. For example, in an embodiment, the cradle lift 133 can be stitched to the front wall 121. In other embodiments the cradle lift 133 may be glued, bonded, welded, etc. to the front wall 121. The cradle lift 133 includes a cradle, trough, or hammock portion 134 when disposed within the PED compartment 120. The cradle portion 134 can be configured to support the PED when disposed within the PED compartment 120 and to upwardly lift or displace the PED relative to the PED compartment 120 when the lift handle 132 is upwardly displaced, as will be discussed below. Upward displacement of the PED by the PED lift member 130 may allow a user to easily grasp the PED to remove the PED from the PED compartment 120. As illustrated in FIG. 2B, the PED compartment 120 can include a guide member 125 coupled to the back wall 122 through which the cradle lift 133 may pass to vertically guide and limit upward displacement of the PED lift member 130.

Figure 3A:
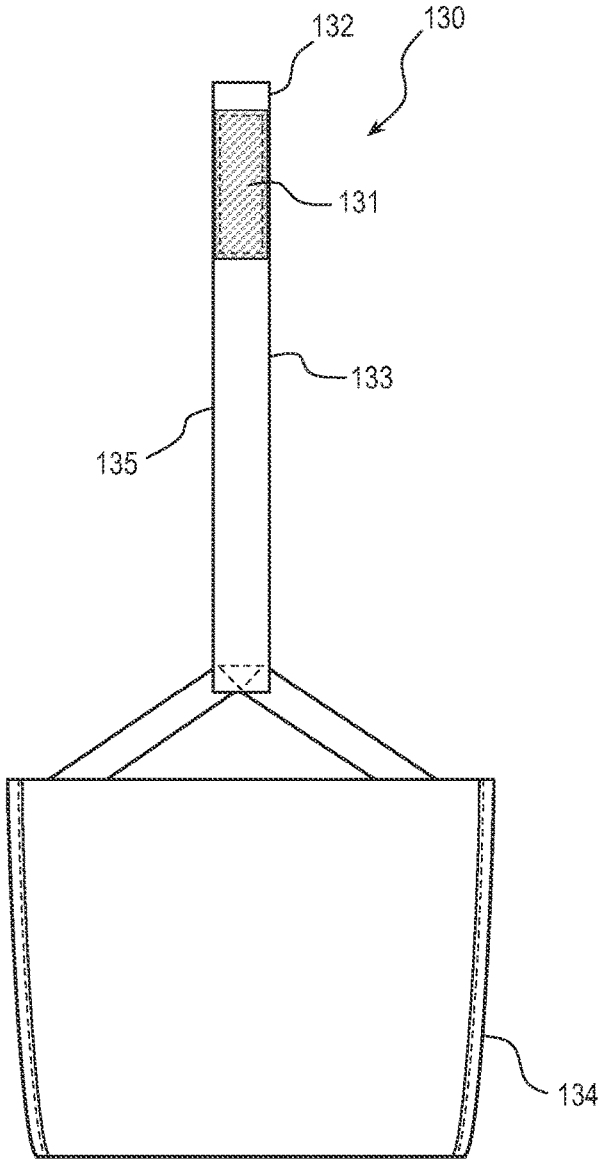
FIG. 3A is a front view of the lift member of FIG. 2A in an extended state.
Figure 3B:
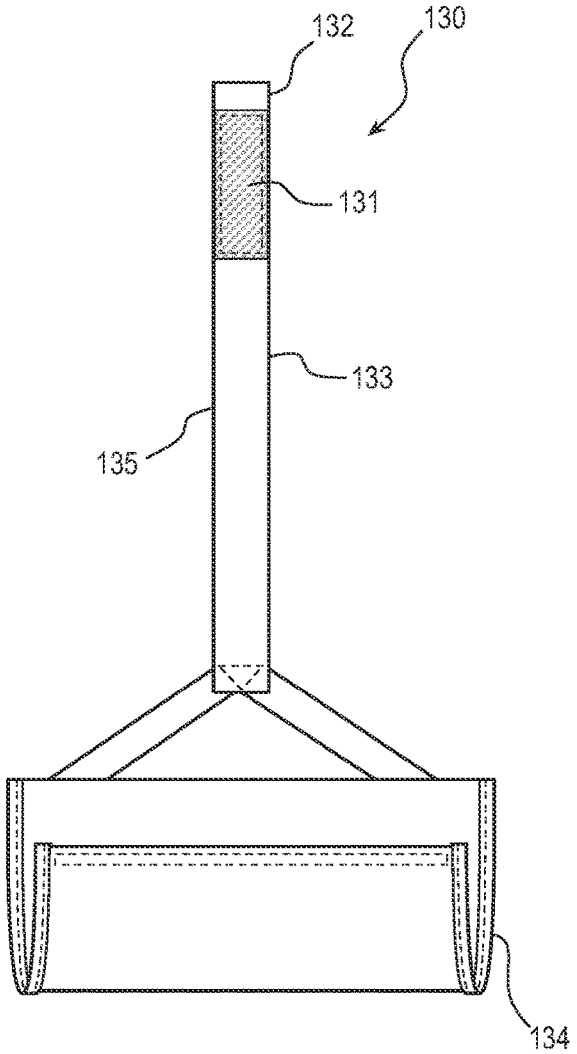
FIG. 3B is a front view of the lift member of FIG. 2A in a lift state.

FIGS. 3A and 3B illustrate the PED lift member 130 in an extended state and a cradle state, respectively. As depicted, the PED lift member 130 includes the lift handle 132 and the cradle lift 133. The lift handle 132 can include a strap formed of a webbing material. The mating securement member 131 may be coupled adjacent a free end of the lift handle 132. The cradle lift 133 may include the cradle portion 134 and a straight portion 135. The lift handle 132 can be coupled to the straight portion 135 and the cradle portion 134 can be coupled to the straight portion 135 such that the straight portion 135 is disposed between the lift handle 132 and the cradle portion 134. The cradle portion 134 may be formed of any suitable compliant material, such as ripstop nylon or a webbing material. The straight portion 135 may include or more straps formed of a webbing material. As illustrated in FIG. 3B, the cradle portion 134 can be formed into a cradle, trough, or hammock shape to support and upwardly lift the PED, wherein the cradle portion 134 is curled toward the straight portion 135.

Figure 4A:
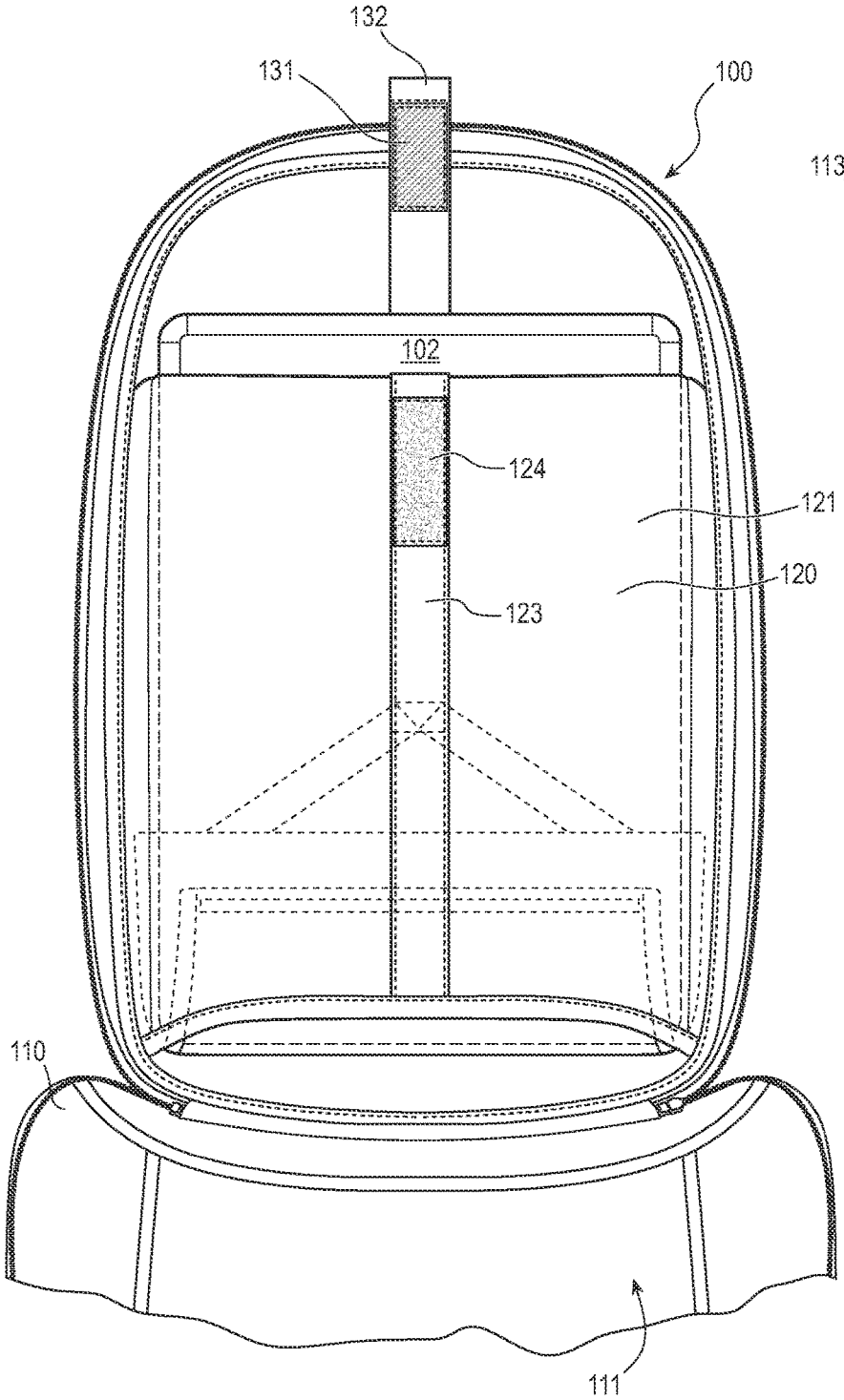
FIG. 4A is a front view of the portable electronic device pocket of FIG. 2A with the lift member in a pre-lift state.
Figure 4B:
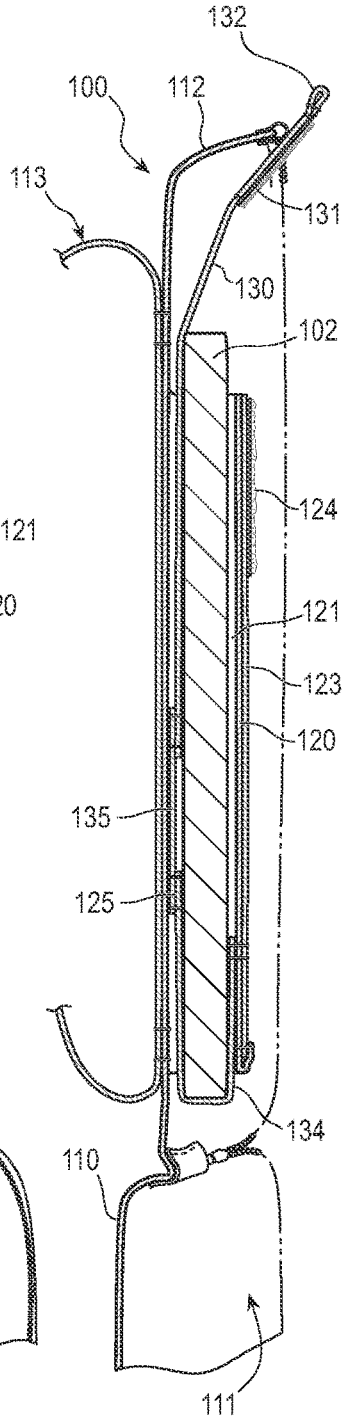
FIG. 4B is a cross-sectional view of the portable electronic device pocket of FIG. 2A with the lift member in the pre-lift state.

FIGS. 4A and 4B illustrate the PED compartment 120 and the PED lift member 130 of the PED carrying case 100 in a pre-lift state. As depicted, a PED 102 is partially disposed within the PED compartment 120. In other embodiments, the PED 102 may be fully disposed within the PED compartment 120. The lift handle 132 of the PED lift member 130 is transitioned from being coupled to the front wall 121 to an upwardly extended position to release the PED from securement within the PED compartment 120 by the lift handle 132.

Figure 5A:
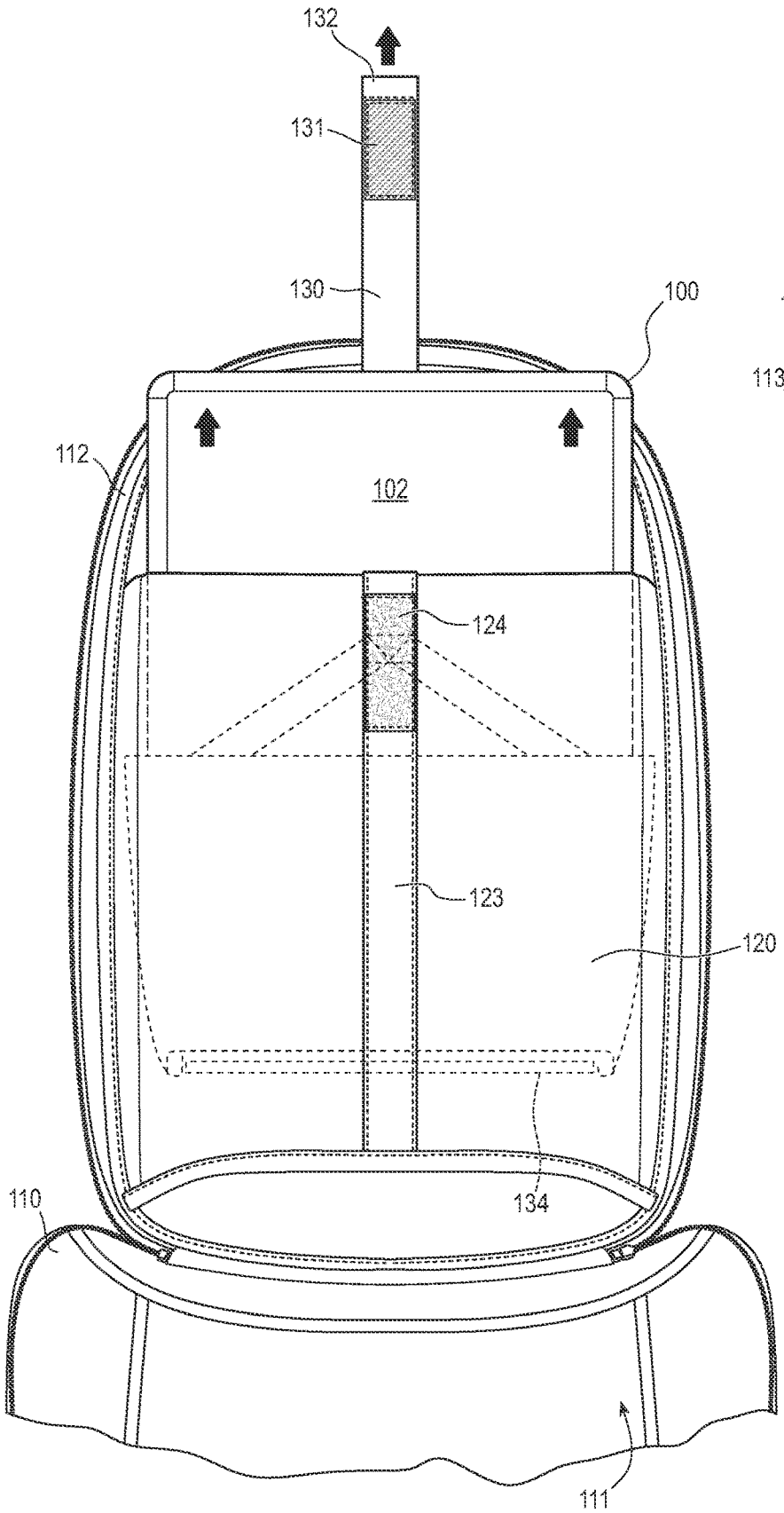
FIG. 5A is a front view of the portable electronic device pocket of FIG. 2A with the lift member in a lift state.
Figure 5B:
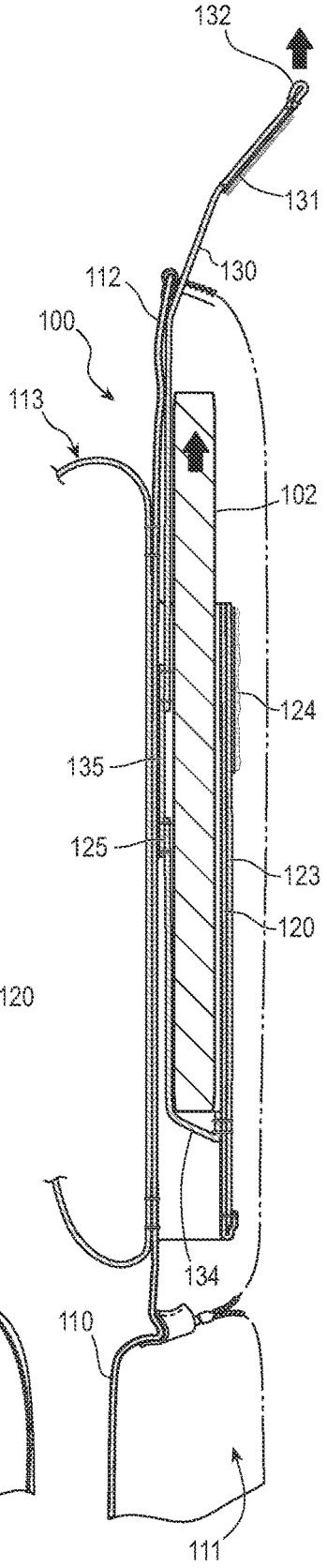
FIG. 5B is a cross-sectional view of the portable electronic device pocket of FIG. 2A with the lift member in the lift state.

FIGS. 5A and 5B illustrate the PED compartment 120 and the PED lift member 130 of the PED carrying case 100 in a lifted state. As depicted, the lift handle 132 is displaced upwardly causing the cradle lift 133 to be upwardly displaced until the guide member 125 is engaged by the cradle portion 134. Upward displacement of the cradle lift 133 may cause the cradle portion 134 to be upwardly displaced resulting in upward displacement of the PED 102. In certain embodiments, the PED 102 may be upwardly displaced a distance of between 5 centimeters and 10 centimeters. When upwardly displaced, the PED 102 may extend out of the PED compartment 120 a greater distance than prior to displacement, thus rendering the PED 102 easier to grasp and remove from the PED compartment 120 by the user.

FIGS. 6A-9B depict an embodiment of a PED carrying case 200 that resembles the PED carrying case 100 described above in certain respects. Accordingly, like features are designated with like reference numerals, with the leading digit incremented to "2." For example, the embodiment depicted in FIGS. 6A-9B includes a PED lift member 230 that may, in some respects, resemble the PED lift member 130 of FIGS. 2A-5B. Relevant disclosure set forth above regarding similarly identified features thus may not be repeated hereafter. Moreover, specific features of the PED carrying case 100 and related components shown in FIGS. 1-5B may not be shown or identified by a reference numeral in the drawings or specifically discussed in the written description that follows. However, such features may clearly be the same, or substantially the same, as features depicted in other embodiments and/or described with respect to such embodiments. Accordingly, the relevant descriptions of such features apply equally to the features of the PED carrying case 200 and related components depicted in FIGS. 6A-9B. Any suitable combination of the features, and variations of the same, described with respect to the PED carrying case 100 and related components illustrated in FIGS. 1-5B can be employed with the PED carrying case 200 and related components of FIGS. 6A-9B, and vice versa. This pattern of disclosure applies equally to further embodiments depicted in subsequent figures and described hereafter, wherein the leading digits may be further incremented.

Figure 6A:
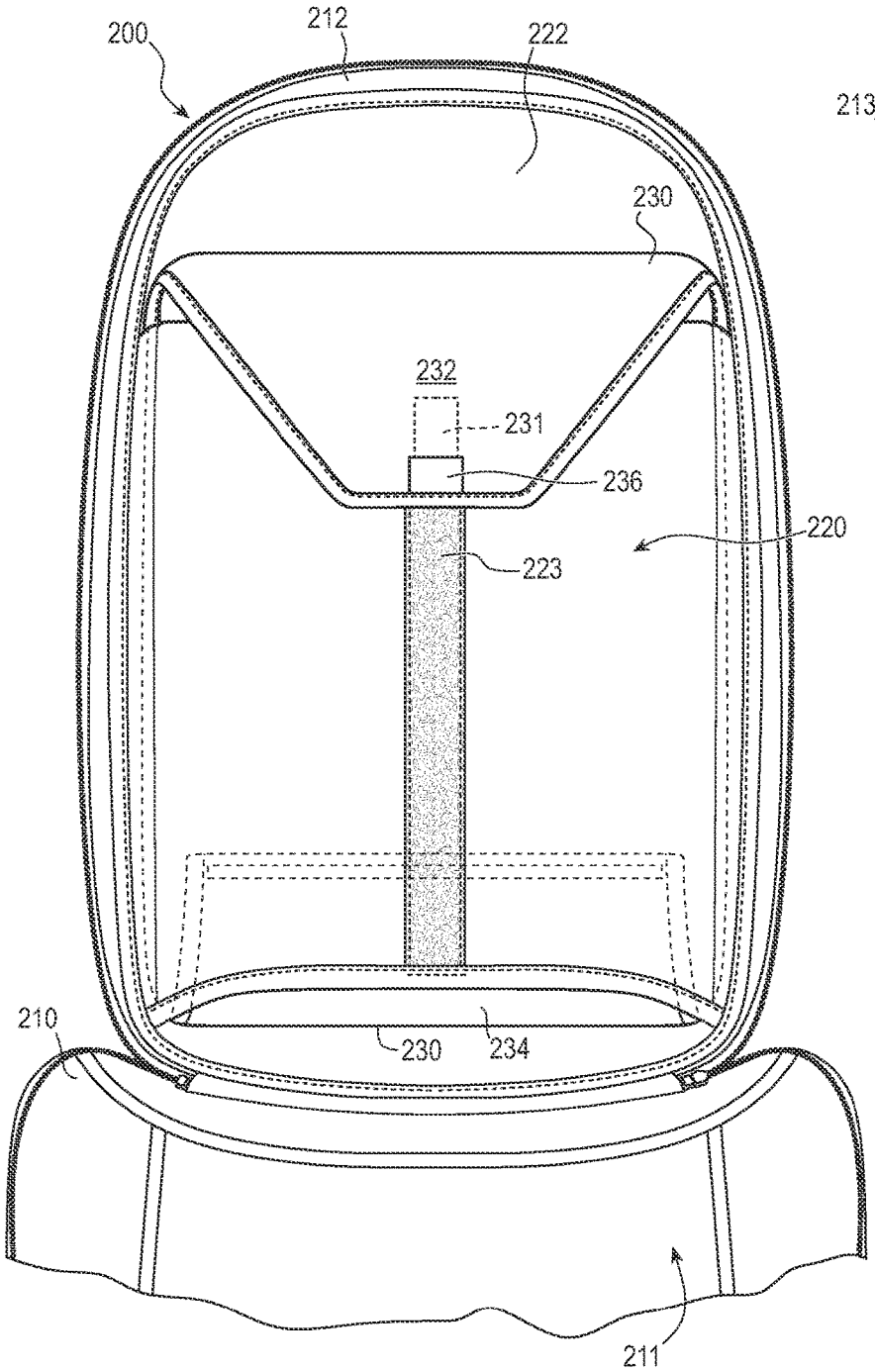
FIG. 6A is a front view of another embodiment of a portable electronic device pocket of FIG. 1 having a lift member.
Figure 6B:
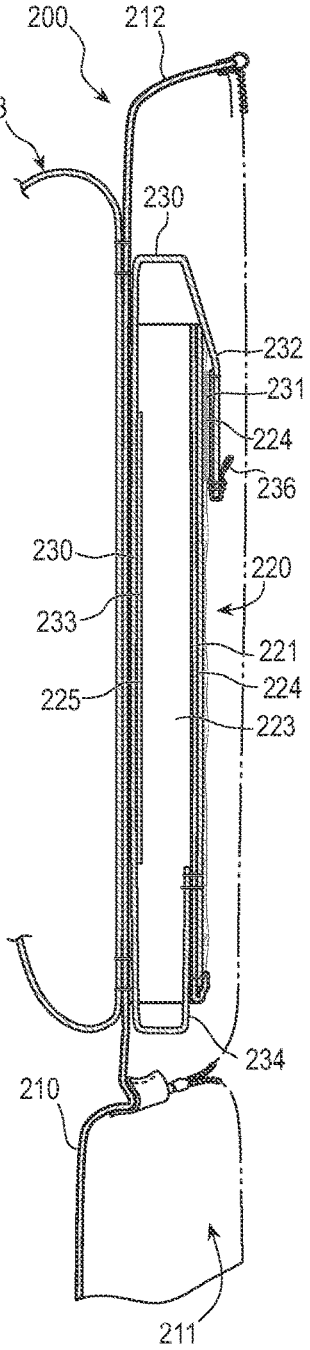
FIG. 6B is a cross-sectional view of the portable electronic device pocket of FIG. 6A.

FIGS. 6A and 6B illustrate another embodiment of a PED compartment or pocket 220 of a PED carrying case 200. As illustrated, the PED compartment 220 includes a front wall 221 and a back wall 222. A space 223 configured to accommodate a PED is disposed between the front wall 221 and the back wall 222. The PED compartment 220 is open at a top end and may be opened at a bottom end. The PED compartment 220 can be sized to accommodate a variety of PED sizes.

A securement member 224 can be coupled to the front wall 221. The securement member 224 may be configured to releasably couple to a mating securement member 231 of a PED lift member 230. The securement members 224, 231 may be any suitable securement mechanism that allows a user to selectively secure and unsecure the PED within the PED compartment 220.

As depicted in FIGS. 6A and 6B, the PED compartment 220 can include the PED lift member 230 at least partially disposed within the PED compartment 220. The PED lift member 230 can include a lift handle 232 and a cradle lift 233 coupled the lift handle 232. An end of the cradle lift 233 can be connected to an inner surface of the front wall 221 using any suitable technique. The cradle lift 233 may include a cradle, trough, or hammock portion 234 when disposed within the PED compartment 220. The cradle portion 234 can be configured to support the PED when disposed within the PED compartment 220 and to upwardly lift or displace the PED relative to the PED compartment 220 when the lift handle 232 is upwardly displaced, as will be discussed below. Upward displacement of the PED by the PED lift member 230 may allow a user to easily grasp the PED to remove the PED from the PED compartment 220.

The lift handle 232 may be configured as a flap that can selectively extend over the opened top end of the PED compartment 220 to retain the PED within the PED compartment 220 even if the PED carrying case 200 is turned upside down. In the depicted embodiment, the lift handle 232 includes a triangular shape. In other embodiments, the lift handle 232 may include any suitable shape, such as rectangular, truncated rectangular, elliptical, oval, etc. The lift handle 232, may include a tab 236 to facilitate lifting and decoupling of the lift handle 232 from the front wall 221.

Figure 7C:
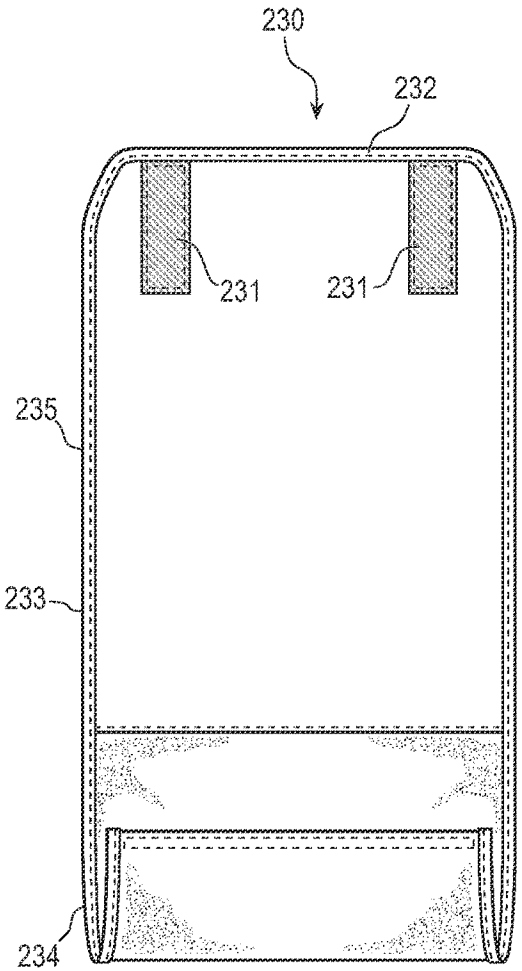
FIG. 7C is a front view of another embodiment of the lift member of FIG. 6A in a lift state.
Figure 7B:
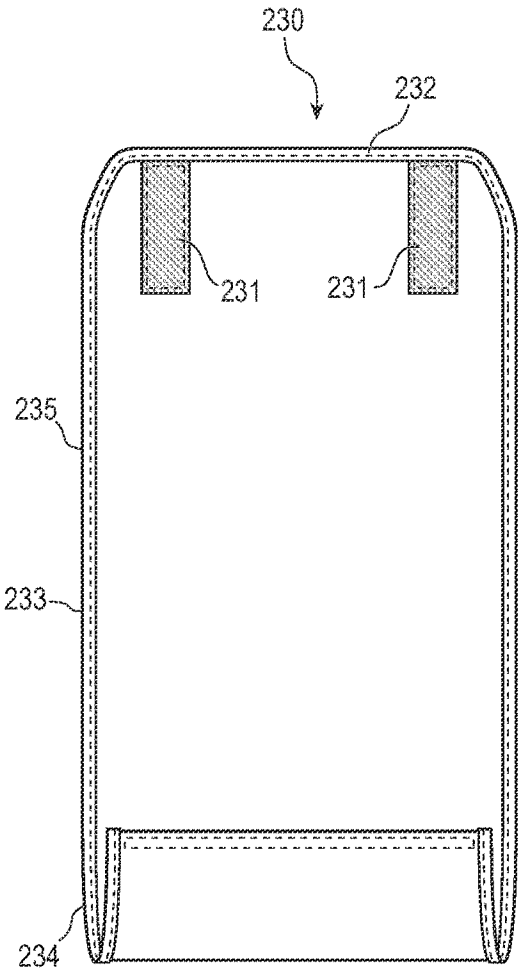
FIG. 7B is a front view of the lift member of FIG. 6A in a lift state.
Figure 7A:
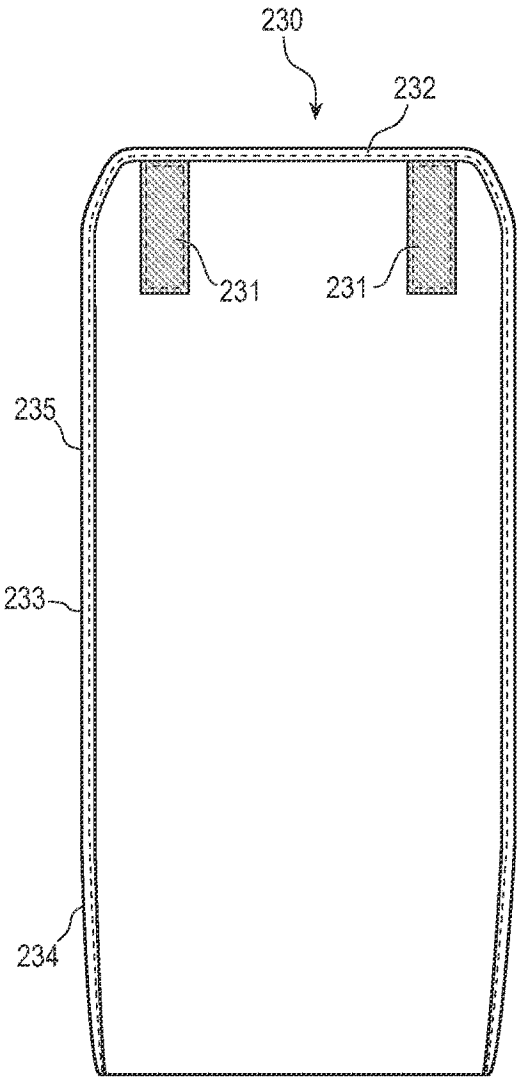
FIG. 7A is a front view of the lift member of FIG. 6A in an extended state.

FIGS. 7A and 7B illustrate the PED lift member 230 in an extended state and a cradle state, respectively. As depicted, the PED lift member 230 includes the lift handle 232 and the cradle lift 233. The lift handle 232 can include ripstop nylon material. The mating securement member 231 may be coupled adjacent a free end of the lift handle 232. The cradle lift 233 may include the cradle portion 234 and a straight portion 235. The lift handle 232 can be coupled to the straight portion 235 and the cradle portion 234 can be coupled to the straight portion 235 such that the straight portion 235 is disposed between the lift handle 232 and the cradle portion 234. The cradle portion 234 may be formed of any suitable compliant material, such as ripstop nylon. As depicted, the lift handle 232 and the cradle lift 233 can be of a unibody construction of a common material, such as ripstop nylon. In another embodiment, as depicted in FIG. 7C, the cradle portion 234 may be formed of an elastomeric material, such as polychloroprene. As illustrated in FIG. 7B, the cradle portion 234 can be formed into a cradle, trough, or hammock shape to support and upwardly lift the PED, wherein the cradle portion 234 is curled toward the straight portion 235. In certain embodiments, one or more of the lift handle 232 and the cradle portion 234 can be padded to protect the PED from damage due to an impact force, such as dropping of the PED carrying case 200.

Figure 8A:
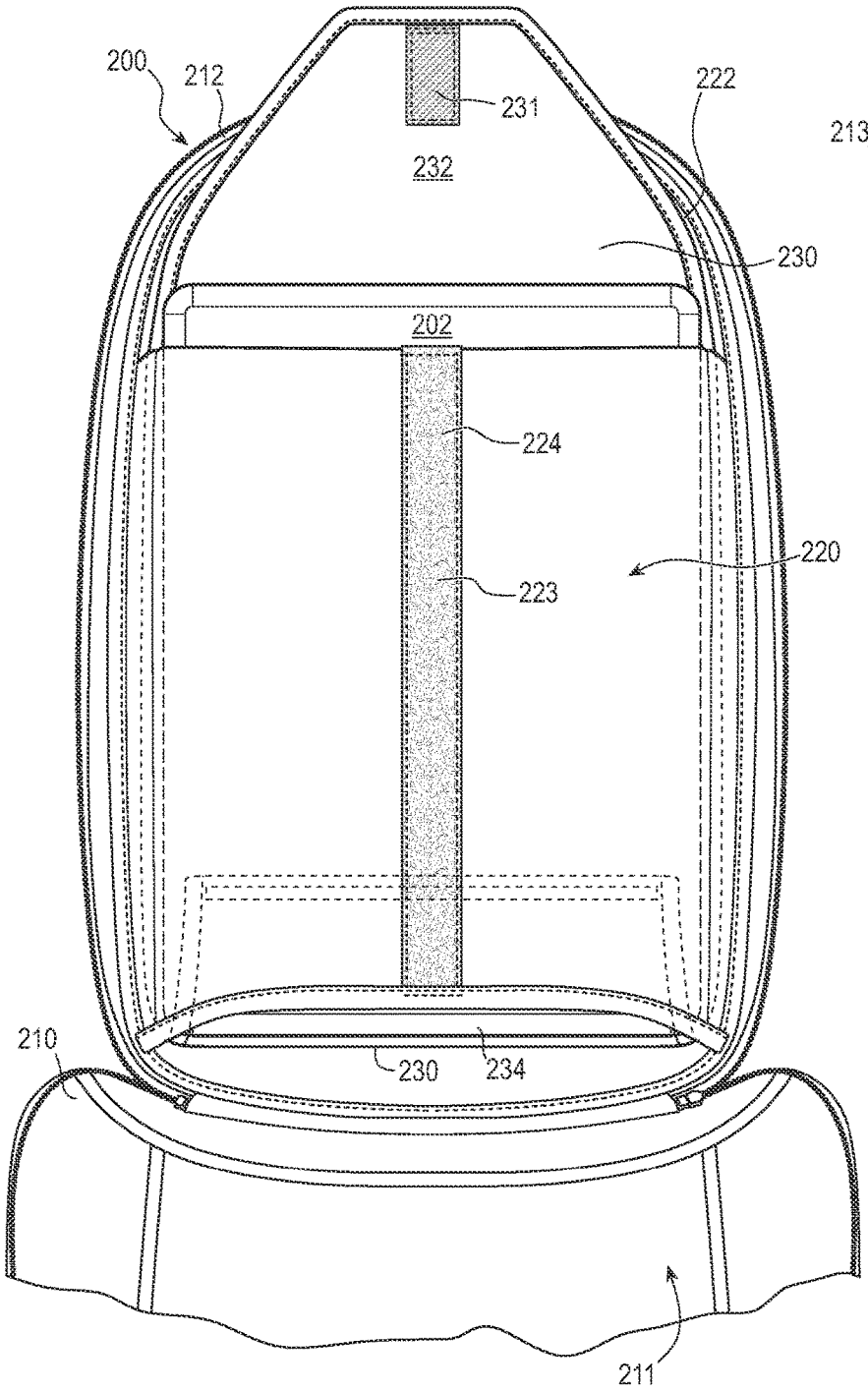
FIG. 8A is a front view of the portable electronic device pocket of FIG. 6A with the lift member in a pre-lift state.
Figure 8B:
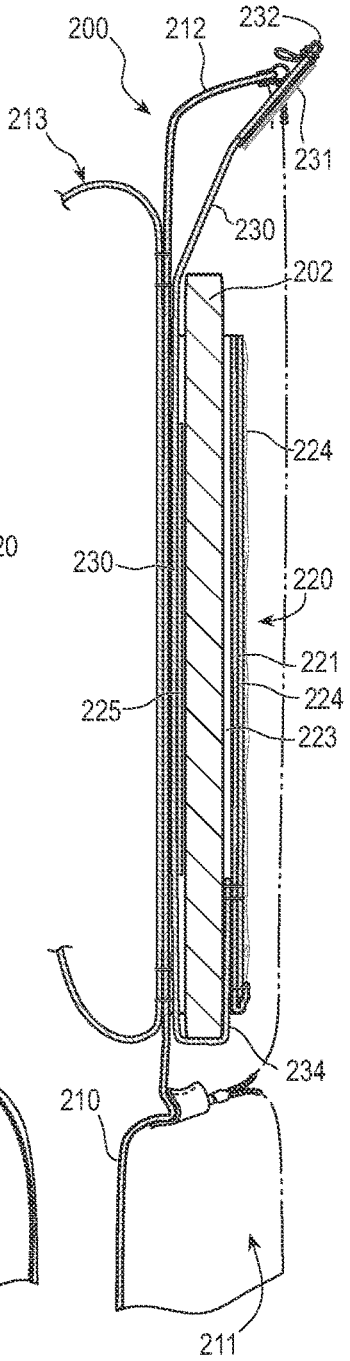
FIG. 8B is a cross-sectional view of the portable electronic device pocket of FIG. 6A with the lift member in the pre-lift state.

FIGS. 8A and 8B illustrate the PED compartment 220 and the lift member 230 of the PED carrying case 200 in a pre-lift state. As depicted, a PED 202 is partially disposed within the PED compartment 220. In other embodiments, the PED 202 may be fully disposed within the PED compartment 220. The lift handle 232 of the lift member 230 is transitioned from being coupled to the front wall 221 and extending downward to cover the open top end of the PED compartment 220 to an upwardly extended position to release the PED 202 from securement within the PED compartment 220 by the flap 232.

Figure 9A:
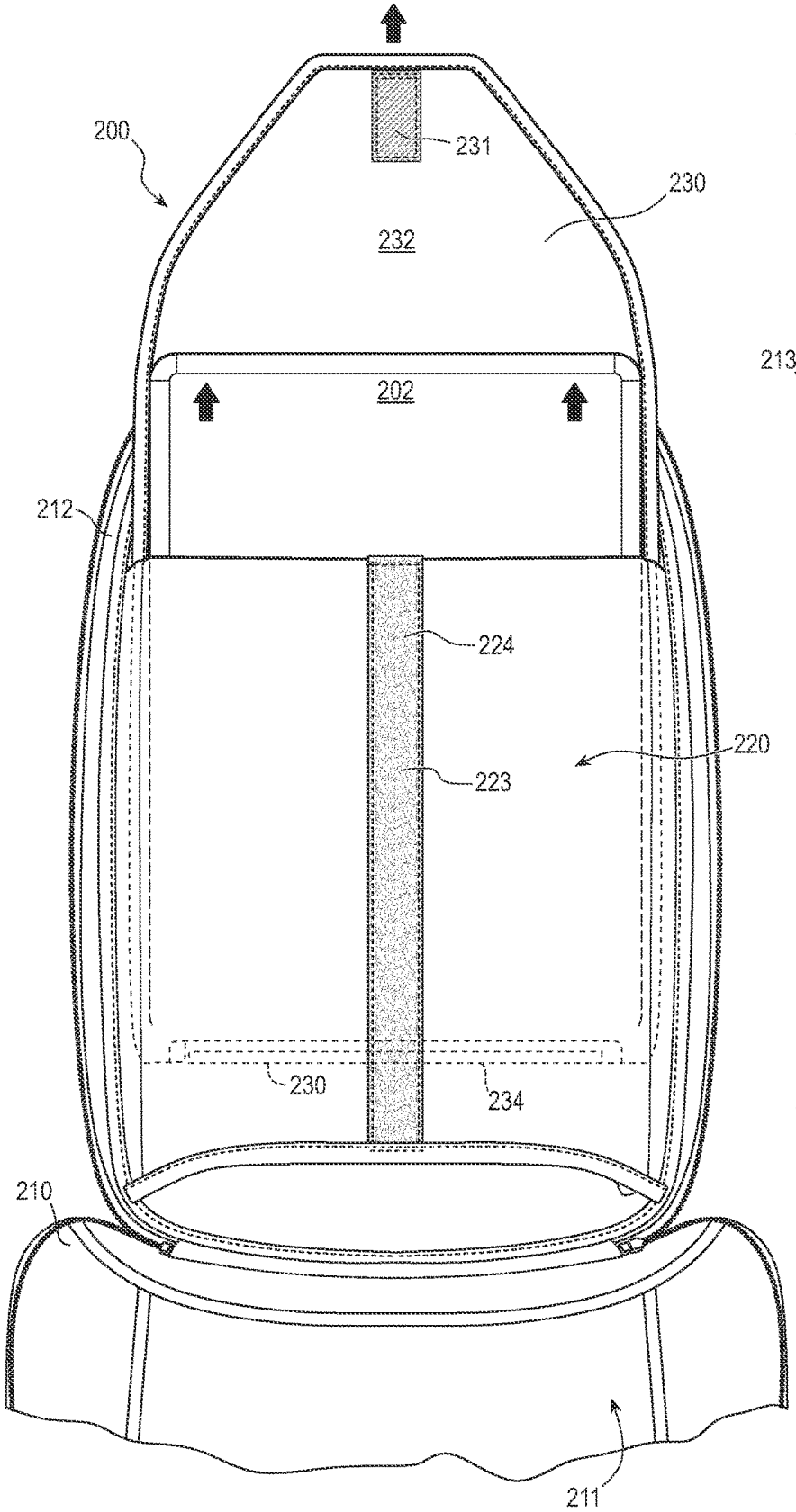
FIG. 9A is a front view of the portable electronic device pocket of FIG. 6A with the lift member in a lift state.
Figure 9B:
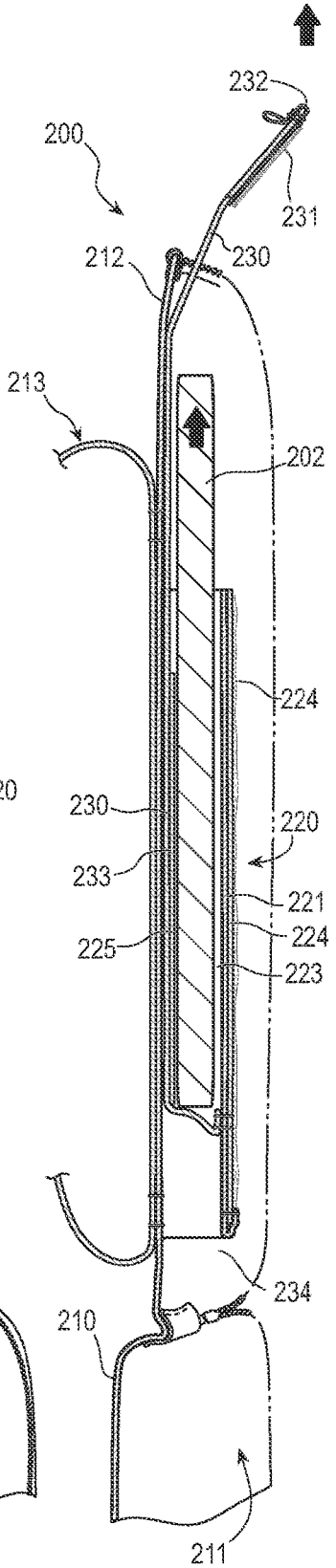
FIG. 9B is a cross-sectional view of the portable electronic device pocket of FIG. 6A with the lift member in the lift state.

FIGS. 9A and 9B illustrate the PED compartment 220 and the lift member 230 of the PED carrying case 200 in a lifted state. As depicted, the lift handle 232 is displaced upwardly, causing the cradle lift 233 to be upwardly displaced until the guide member 225 is engaged with the cradle portion 234 to prevent further upward displacement. Upward displacement of the cradle lift 233 may cause the cradle portion 234 to be upwardly displaced resulting in upward displacement of the PED 202. When upwardly displaced, the PED 202 may extend out of the PED compartment 220 a greater distance than prior to displacement, thus rendering the PED 202 easier to grasp and remove from the PED compartment 220 by the user.

FIG. 10 illustrates another embodiment of a compartment 320 of a PED carrying case 300. As depicted, the compartment 320 may include a first or upper securement member 324*a* and a second or lower securement member 324*b*. The securement members 324*a*, 324*b* may be disposed on an outer surface of a front wall 321 and oriented horizontally relative to the compartment 320. The securement members 324*a*, 324*b* may also be oriented parallel to one another with a space disposed between them. In other embodiments, the number of securement members may be three, four, five, or more.

A PED lift member 330 can be at least partially disposed within the compartment 320. The PED lift member 330 may include a lift handle 332, such as a flap or strap. The lift handle 332 can include one or more mating securement members 331 configured to releasably couple with one or more of the securement members 324*a*, 324*b*.

Figure 11C:
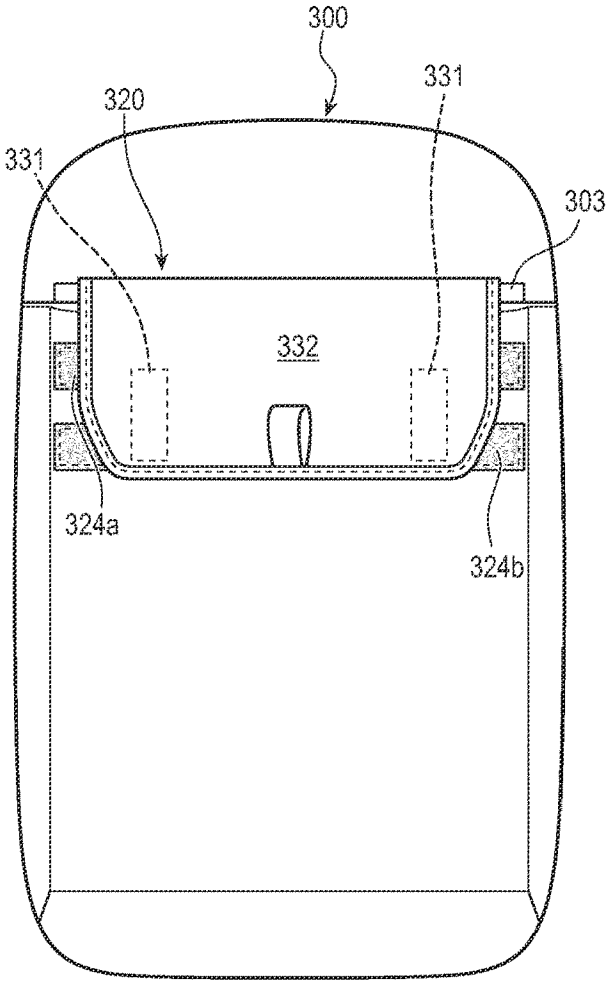
FIG. 11C is a front view of the portable electronic device pocket of FIG. 10 with the handle of the lift member in a second securement position.
Figure 11B:
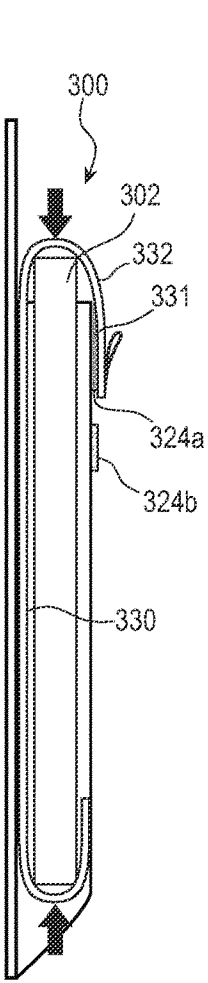
FIG. 11B is a cross-sectional view of the portable electronic device pocket of FIG. 10 with the handle of the lift member in the first securement position.
Figure 11A:
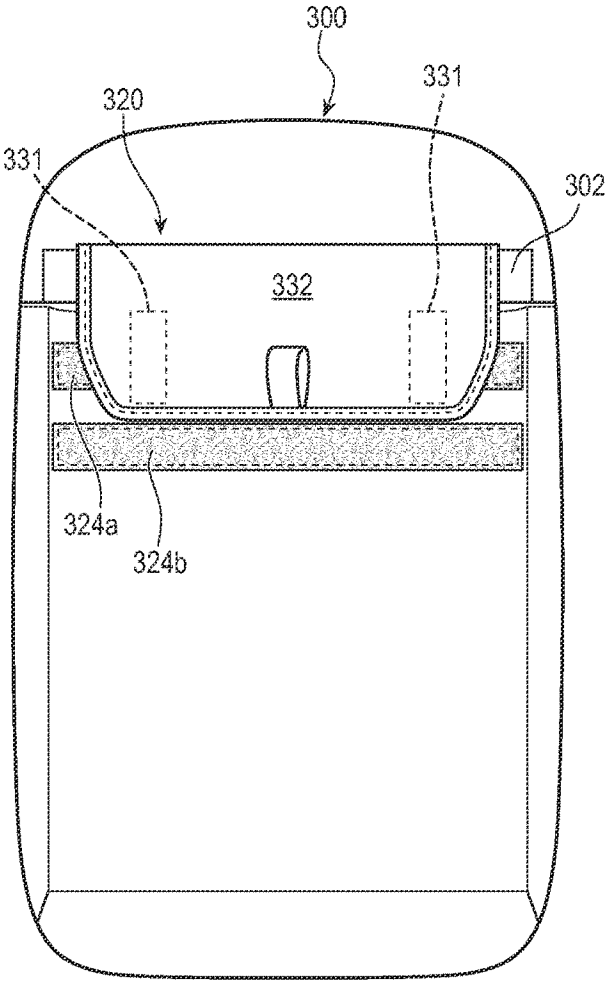
FIG. 11A is a front view of the portable electronic device pocket of FIG. 10 with a handle of another embodiment of a lift member in a first securement position.

FIGS. 11A and 11B, illustrate the compartment 320 and PED lift member 330 of the PED carrying case 300 in a first PED securement state. The first PED securement state may be configured to secure a relatively large PED 302. As depicted the lift handle 332 may be disposed over the PED 302 such that the mating securement members 331 are coupled to the securement member 324*a*. The lift handle 332 may be coupled to the PED 302 to prevent unintentional movement of the PED 302 within the compartment 320 as the PED carrying case 300 is being transported by the user. Unintentional movement of the PED 302 may result in damage to the PED 302, such as breakage of a screen.

FIGS. 11C and 11D, illustrate the compartment 320 and PED lift member 330 of the PED carrying case 300 in a second PED securement state. The second PED securement state may be configured to secure a relatively small PED 303. As depicted, the lift handle 332 may be disposed over the PED 303 such that the mating securement members 331 are coupled to the securement members 324*a* and 324*b*. The lift handle 332 may be coupled to the PED 303 to prevent unintentional movement of the PED 303 within the compartment 320 as the PED carrying case 300 is being transported by the user. Unintentional movement of the PED 303 may result in damage to the PED 303, such as breakage of a screen.

Any method disclosed herein comprises one or more steps or actions for performing the described method. The method steps and/or actions may be interchanged with one another. In other words, unless a specific order of steps or actions is required for proper operation of the embodiment, the order and/or use of specific steps and/or actions may be modified. For example, a method of removing a PED from a PED carrying case may include one or more of the following steps: disposing a PED in a lift member of a PED compartment of a PED carrying case; upwardly displacing a lift handle of the lift member; upwardly displacing a lift cradle of the lift member; upwardly displacing the PED relative to the PED compartment by the lift cradle; and removing the PED from the lift member and the PED compartment. Other steps are also contemplated.

Embodiments may be understood by reference to the drawings, wherein like parts are designated by like numerals throughout. It will be readily understood by one of ordinary skill in the art having the benefit of this disclosure that the components of the embodiments, as generally described and illustrated in the figures herein, could be arranged and designed in a wide variety of different configurations. Thus, the following more detailed description of various embodiments, as represented in the figures, is not intended to limit the scope of the disclosure, but is merely representative of various embodiments. While the various aspects of the embodiments are presented in drawings, the drawings are not necessarily drawn to scale unless specifically indicated.

Reference throughout this specification to "an embodiment" or "the embodiment" means that a particular feature, structure, or characteristic described in connection with that embodiment is included in at least one embodiment. Thus, the quoted phrases, or variations thereof, as recited throughout this specification are not necessarily all referring to the same embodiment.

Similarly, in the above description of embodiments, various features are sometimes grouped together in a single embodiment, figure, or description thereof for the purpose of streamlining the disclosure. This method of disclosure, however, is not to be interpreted as reflecting an intention that any claim requires more features than those expressly recited in that claim. Rather, as the following claims reflect, inventive aspects lie in a combination of fewer than all features of any single foregoing disclosed embodiment.

The phrase "coupled to" refers to any form of interaction between two or more entities, including mechanical, electrical, magnetic, electromagnetic, fluid, and thermal interaction. Two components may be coupled to each other even though they are not in direct contact with each other. For example, two components may be coupled to each other through an intermediate component.

References to approximations are made throughout this specification, such as by use of the term "about." For each such reference, it is to be understood that, in some embodiments, the value, feature, or characteristic may be specified without approximation. For example, where qualifier such as "about" is used, the term includes within its scope the qualified word in the absence of their qualifier.

The terms "a" and "an" can be described as one, but not limited to one. For example, although the disclosure may recite a PED compartment including a PED lift member" the disclosure also contemplates that the PED compartment can have two or more PED lift members.

Unless otherwise stated, all ranges include both endpoints and all numbers between the endpoints.

Recitation in the claims of the term "first" with respect to a feature or element does not necessarily imply the existence of a second or additional such feature or element.

The claims following this written disclosure are hereby expressly incorporated into the present written disclosure, with each claim standing on its own as a separate embodiment. This disclosure includes all permutations of the independent claims with their dependent claims. Moreover, additional embodiments capable of derivation from the independent and dependent claims that follow are also expressly incorporated into the present written description.

Without further elaboration, it is believed that one skilled in the art can use the preceding description to utilize the invention to its fullest extent. The claims and embodiments disclosed herein are to be construed as merely illustrative and exemplary, and not a limitation of the scope of the present disclosure in any way. It will be apparent to those having ordinary skill in the art, with the aid of the present disclosure, that changes may be made to the details of the above-described embodiments without departing from the underlying principles of the disclosure herein. In other words, various modifications and improvements of the embodiments specifically disclosed in the description above are within the scope of the appended claims. Moreover, the order of the steps or actions of the methods disclosed herein may be changed by those skilled in the art without departing from the scope of the present disclosure. In other words, unless a specific order of steps or actions is required for proper operation of the embodiment, the order or use of specific steps or actions may be modified. The scope of the invention is therefore defined by the following claims and their equivalents.

The invention claimed is:

1. A carrying case for a portable electronic device (PED), comprising:

an outer wall defining a primary compartment and a PED compartment, the outer wall comprising an outer surface facing outside of the carrying case and an inner surface that contacts the PED responsive to placement of the PED in the PED compartment;

an inner wall dividing the primary compartment from the PED compartment;

a PED lift member within the PED compartment, the PED lift member comprising:

a lift handle comprising a distal end of a single strap, the lift handle upwardly displaceable relative to the PED compartment; and;

a cradle portion coupled to a proximal end of the single strap by a plurality of straps coupled to an end of the cradle portion, the plurality of straps converging toward the proximal end of the single strap, the cradle portion configured to vertically suspend a PED within the PED compartment and to upwardly lift the PED relative to the PED compartment at least partially out of the PED compartment responsive to upward displacement of the lift handle; and a guide member coupled to and protruding from the inner surface of the outer wall, at least a portion of the lift member passing through the guide member, the guide member limiting the upward displacement of the lift handle responsive to engagement of the plurality of straps or the cradle portion that is wider than the portion of the lift member passing through the guide member with the guide member.

2. The carrying case for a PED of claim 1, wherein the cradle portion is coupled to the inner wall at a first end and to the lift handle via the plurality of straps at a second end, wherein the cradle portion comprises a trough shaped portion, and wherein the trough shaped portion is configured to upwardly lift the PED relative to the PED compartment when the lift handle is upwardly displaced.

3. The carrying case for a PED of claim 1, wherein the lift handle comprises a first releasable fastener configured to couple with a second releasable fastener coupled to the inner wall.

4. The carrying case for a PED of claim 3, wherein the first and second releasable fasteners comprise one or more of a hook-and-loop material, a snap socket and stud, and a zipper.

5. The carrying case for a PED of claim 1, wherein the end of the cradle portion that is coupled to the plurality of straps is wider than an opposite end of the cradle portion that is coupled to the inner wall.

6. The carrying case for a PED of claim 1, wherein the PED lift member further comprises a vertical portion comprising a portion of the single strap disposed between the cradle portion and the lift handle.

7. The carrying case for a PED of claim 6, wherein the cradle portion comprises one or more of a ripstop nylon material and an elastomeric material, and wherein the vertical portion comprises one or more of a ripstop nylon material and a webbing material.

8. The carrying case for a PED of claim 7, wherein the elastomeric material is neoprene.

9. The carrying case for a PED of claim 1, wherein the PED comprises one or more of a laptop computer, a notebook computer, and a tablet computer.

10. A lift for a portable electronic device (PED) carrying case, comprising:

a lift handle comprising a distal end of a single strap, the lift handle upwardly displaceable;

a vertical portion comprising a portion of the single strap; and a cradle portion coupled to a proximal end of the single strap by a plurality of straps coupled to an end of the cradle portion, the plurality of straps converging toward the proximal end of the single strap, the cradle portion configured to vertically suspend a PED within a PED compartment of a PED carrying case and to upwardly displace the PED relative to the PED compartment when the lift handle is upwardly displaced, the vertical portion disposed between the cradle portion and the lift handle, the vertical portion configured to pass through a guide member coupled to and protruding from an outer wall of the PED carrying case, the vertical portion configured for positioning between the outer wall and the PED responsive to positioning of the PED within the PED compartment, an inner surface of the outer wall in contact with the PED responsive to positioning of the PED within the PED compartment, at least a portion of the cradle portion wider than the vertical portion to limit upward displacement of the lift handle responsive to engagement of the plurality of straps or at least a portion of the cradle portion with the guide member.

11. The lift for a PED device carrying case of claim 10, wherein the cradle portion is configured to operably couple with the PED, and the vertical portion is configured to be upwardly displaced when the lift handle is upwardly displaced.

12. The lift for a PED carrying case of claim 10, wherein the end of the cradle portion that is coupled to the plurality of straps is wider than an opposite end of the cradle portion that is coupled to an inner wall.

13. The lift for a PED carrying case of claim 10, wherein the cradle portion comprises one or more of a sheet of ripstop nylon material and a sheet of elastomeric material, and wherein the vertical portion comprises one or more of a sheet of ripstop nylon material and a webbing material.

14. The lift for a portable electronic device carrying bag of claim 13, wherein the elastomeric material is neoprene.

15. A method of removing a portable electronic device (PED) from a PED carrying case, comprising:

disposing a PED in a lift member of a PED compartment of a PED carrying case with the PED in contact with an inner surface of an outer wall of the PED carrying case and a vertical portion of the lift member passing through a guide member coupled to and protruding from the outer wall, the vertical portion including a portion of a single strap;

upwardly displacing a lift handle of the lift member, the lift handle comprising a distal end of the single strap;

upwardly displacing a cradle portion of the lift member, the cradle portion coupled to a proximal end of the single strap by a plurality of straps, the cradle portion wider than the at least the vertical portion of the lift member passing through the guide member;

limiting upward displacement of the lift handle responsive to engagement of the cradle portion or the plurality of straps with the guide member;

upwardly displacing the PED relative to the PED compartment by the cradle portion; and removing the PED from the lift member and the PED compartment.

16. The method of claim 15, further comprising releasing the lift handle from a wall of the portable electronic device compartment.

17. The method of claim 15, further comprising coupling the lift handle to a wall of the portable electronic device compartment in a first position to secure a first sized PED within the PED compartment.

18. The method of claim 15, further comprising coupling the lift handle to a wall of the portable electronic device compartment in a second position to secure a second PED within the PED compartment.

* * * * *